US008160872B2

(12) United States Patent
Stachurski

(10) Patent No.: US 8,160,872 B2
(45) Date of Patent: Apr. 17, 2012

(54) METHOD AND APPARATUS FOR LAYERED CODE-EXCITED LINEAR PREDICTION SPEECH UTILIZING LINEAR PREDICTION EXCITATION CORRESPONDING TO OPTIMAL GAINS

(75) Inventor: Jacek P. Stachurski, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1019 days.

(21) Appl. No.: 12/061,937

(22) Filed: Apr. 3, 2008

(65) Prior Publication Data

US 2008/0249784 A1 Oct. 9, 2008

Related U.S. Application Data

(60) Provisional application No. 60/910,343, filed on Apr. 5, 2007.

(51) Int. Cl.
*G10L 19/14* (2006.01)

(52) U.S. Cl. ..... 704/225; 704/230; 704/207; 704/229; 704/219; 704/223

(58) Field of Classification Search ..... 704/222, 704/223, 219, 220, 207, 500, 226, 503, 221, 704/262, 230, 264, 225, 258, 229
See application file for complete search history.

(56) References Cited

U.S. PATENT DOCUMENTS 6,311,154 B1 * 10/2001 Gersho et al. ..... 704/219
6,345,255 B1 * 2/2002 Mermelstein ..... 704/500
6,393,390 B1 * 5/2002 Patel et al. ..... 704/207
6,757,649 B1 * 6/2004 Gao et al. ..... 704/222
6,782,360 B1 * 8/2004 Gao et al. ..... 704/222
6,961,698 B1 * 11/2005 Gao et al. ..... 704/229
6,996,522 B2 * 2/2006 Chen ..... 704/219
7,149,683 B2 * 12/2006 Jelinek ..... 704/208
7,272,555 B2 * 9/2007 Lee et al. ..... 704/219
7,359,855 B2 * 4/2008 Patel et al. ..... 704/223
7,596,491 B1 * 9/2009 Stachurski ..... 704/219
7,680,651 B2 * 3/2010 Tammi et al. ..... 704/219
7,693,710 B2 * 4/2010 Jelinek et al. ..... 704/207
7,742,917 B2 * 6/2010 Yamaura ..... 704/223
7,747,441 B2 * 6/2010 Yamaura ..... 704/264
7,752,039 B2 * 7/2010 Bessette ..... 704/223
7,783,480 B2 * 8/2010 Yoshida ..... 704/219
7,937,267 B2 * 5/2011 Yamaura ..... 704/219

(Continued)

OTHER PUBLICATIONS

B. Bessette et al., The Adaptive Multi-Rate Wideband Speech Codec (AMR-WB), IEEE Tran. Speech and Audio Processing 620, pp. 1-40, 2002.

(Continued)

*Primary Examiner* — Vijay B Chawan
(74) *Attorney, Agent, or Firm* — Mirna Abyad; Wade J. Brady, III; Frederick J. Telecky, Jr.

(57) ABSTRACT

A layered code-excited linear prediction (CELP) encoder, an Adaptive Multirate Wideband (AMR-WB) encoder and methods of CELP encoding and decoding. In one embodiment, the encoder includes: (1) a core layer subencoder and (2) at least one enhancement layer subencoder, at least one of the core layer subencoder and the enhancement layer subencoder having first and second adaptive codebooks and configured to retrieve a pitch lag estimate from the second adaptive codebook and perform a closed-loop search of the first adaptive codebook based on the pitch lag estimate.

20 Claims, 6 Drawing Sheets

U.S. PATENT DOCUMENTS

| | | | | |
|---|---|---|---|---|
| 2002/0107686 | A1* | 8/2002 | Unno | 704/219 |
| 2002/0133335 | A1* | 9/2002 | Chen | 704/219 |
| 2003/0200092 | A1* | 10/2003 | Gao et al. | 704/258 |
| 2004/0024594 | A1* | 2/2004 | Lee et al. | 704/219 |
| 2006/0173677 | A1* | 8/2006 | Sato et al. | 704/223 |
| 2007/0299669 | A1* | 12/2007 | Ehara | 704/262 |
| 2008/0249766 | A1* | 10/2008 | Ehara | 704/203 |
| 2008/0249783 | A1* | 10/2008 | Stachurski | 704/500 |
| 2008/0281587 | A1* | 11/2008 | Yoshida | 704/223 |
| 2009/0094023 | A1* | 4/2009 | Sung et al. | 704/219 |

OTHER PUBLICATIONS

J-P Adoul et al., "Fast CELP Coding Based on Algebraic Codes" Proc. IEEE Int. Conf. on Acoustics, Speech, Signal Processing, Dallas, pp. 1957-1960, Apr. 1987.

Peter Kroon et al., "A Class of Analysis-by-Synthesis Predictive Coders for High Quality Speech Coding at Rates Between 4.8 and 16 kbits/s" IEEE Journal on Selected Areas in Communications, pp. 353-363, Feb. 1988.

Manfred R. Schroeder et al., "Code-Excited Linear Prediction (CELP): High-Quality Speech at Very Low Bit Rates" Proc. IEEE Int. Conf. on Acoustics, Speech, Signal Processing, Tampa, pp. 937-940, Mar. 1985.

Stachurski "Layered CELP System and Method" U.S. Appl. No. 11/279,932, Filed Apr. 17, 2006.

Jacek. P. Stachurski, "Layered Code-Excited Linear Prediction Speech Encoder and Decoder Having Plural Codebook Contributions in Enhancement Layers Thereof and Methods of Layered CELP Encoding and Decoding", U.S. Appl. No. 12/061,931, Filed Apr. 3, 2008.

* cited by examiner

METHOD AND APPARATUS FOR LAYERED CODE-EXCITED LINEAR PREDICTION SPEECH UTILIZING LINEAR PREDICTION EXCITATION CORRESPONDING TO OPTIMAL GAINS

CROSS-REFERENCE TO PROVISIONAL APPLICATION

This application claims the benefit of U.S. Provisional Application Ser. No. 60/910,343, filed by Stachurski on Apr. 5, 2007, entitled "CELP System and Method," commonly assigned with the invention and incorporated herein by reference. Co-pending U.S. patent application Ser. Nos. 11/279,932, filed by Stachurski on Apr. 17, 2006, entitled "Layered CELP System and Method" and [TI-64406], filed by Stachurski on even date herewith, entitled "Layered Code-Excited Linear Prediction Speech Encoder and Decoder Having Plural Codebook Contributions in Enhancement Layers Thereof and Methods of Layered CELP Encoding and Decoding," both commonly assigned with the invention and incorporated herein by reference, disclose related subject matter.

TECHNICAL FIELD OF THE INVENTION

The invention is directed, in general, to electronic devices and digital signal processing and, more specifically, to a layered code-excited linear prediction (CELP) speech encoder and decoder having plural codebook contributions in enhancement layers thereof and methods of layered CELP encoding and decoding that employ the contributions.

BACKGROUND OF THE INVENTION

The performance of digital speech systems using low bit rates has become increasingly important with current and foreseeable digital communications. Both dedicated channel and packetized voice-over-internet protocol (VoIP) transmission benefit from compression of speech signals. The widely-used linear prediction (LP) digital speech coding method (see, e.g., Schroeder, et al., "Code-Excited Linear Prediction (CELP): High Quality Speech at Very Low Bit Rates," in Proc. IEEE Int. Conf, on Acoustics, Speech, Signal Processing, (Tampa), pp. 937-940, March 1985) models the vocal tract as a time-varying filter and a time-varying excitation of the filter to mimic human speech. Linear prediction analysis determines linear prediction (LP) coefficients a(j), j=1, 2, . . . , M, for an input frame of digital speech samples {s(n)} by setting:

$$r(n)=s(n)-\Sigma_{M\geqq j\geqq 1}a(j)s(n-j) \quad (1)$$

and minimizing $\Sigma_{frame}r(n)_2$. Typically, M, the order of the linear prediction filter, is taken to be about 10-12; the sampling rate to form the samples s(n) is typically taken to be 8 kHz (the same as the public switched telephone network, or PSTN, sampling for digital transmission and which corresponds to a voiceband of about 0.3-3.4 kHz); and the number of samples {s(n)} in a frame is often 80 or 160 (10 or 20 ms frames). Various windowing operations may be applied to the samples of the input speech frame. The name "linear prediction" arises from the interpretation of the residual $r(n)=s(n)-\Sigma_{M\geqq j\geqq 1}a(j)s(n-j)$ as the error in predicting s(n) by a linear combination of preceding speech samples $\Sigma_{M\geqq j\geqq 1}a(j)s(n-j)$; that is, a linear autoregression. Thus minimizing $\Sigma_{frame}r(n)^2$ yields the {a(j)} which furnish the best linear prediction. The coefficients {a(j)} may be converted to line spectral frequencies (LSFs) or immittance spectrum pairs (ISPs) for vector quantization plus transmission and/or storage.

The {r(n)} form the LP residual for the frame, and ideally the LP residual would be the excitation for the synthesis filter 1/A(z) where A(z) is the transfer function of Equation (1); that is, Equation (1) is a convolution that z-transforms to a multiplication: R(z)=A(z)S(z), so S(z)=R(z)/A(z). Of course, the LP residual is not available at the decoder; thus the task of the encoder is to represent the LP residual so that the decoder can generate an excitation for the LP synthesis filter. That is, from the encoded parameters the decoder generates a filter estimate, A(z), plus an estimate of the residual to use as an excitation, E(z); and thereby estimates the speech frame by $\hat{S}(z)=E(z)/\hat{A}(z)$. Physiologically, for voiced frames the excitation roughly has the form of a series of pulses at the pitch frequency, and for unvoiced frames the excitation roughly has the form of white noise.

For compression the LP approach basically quantizes various parameters and only transmits/stores updates or codebook entries for these quantized parameters, filter coefficients, pitch lag, residual waveform, and gains. A receiver regenerates the speech with the same perceptual characteristics as the input speech. Periodic updating of the quantized items requires fewer bits than direct representation of the speech signal, so a reasonable LP encoder can operate at bits rates as low as 2-3 kb/s (kilobits per second).

For example, the Adaptive Multirate Wideband (AMR-WB) encoding standard with available bit rates ranging from 6.6 kb/s up to 23.85 kb/s uses LP analysis with codebook excitation (CELP) to compress speech. An adaptive-codebook contribution provides periodicity in the excitation and is the product of a gain, $g_P$, multiplied by v(n), the excitation of the prior frame translated by the pitch lag of the current frame and interpolated to fit the current frame. The algebraic codebook contribution approximates the difference between the actual residual and the adaptive codebook contribution with a multiple-pulse vector (also known as an innovation sequence), c(n), multiplied by a gain, $g_C$. The number of pulses depends on the bit rate. That is, the excitation is $u(n)=g_Pv(n)+g_Cc(n)$ where v(n) comes from the prior (decoded) frame, and $g_P$, $g_C$, and c(n) come from the transmitted parameters for the current frame. The speech synthesized from the excitation is then postfiltered to mask noise. Postfiltering essentially involves three successive filters: a short-term filter, a long-term filter, and a tilt compensation filter. The short-term filter emphasizes formants; the long-term filter emphasizes periodicity, and the tilt compensation filter compensates for the spectral tilt typical of the short-term filter. See, e.g., Bessette, et al., The Adaptive Multirate Wideband Speech Codec (AMR-VVB), 10 IEEE Tran. Speech and Audio Processing 620 (2002).

A layered (embedded) CELP speech encoder, such as the MPEG-4 audio CELP, provides bit rate scalability with an output bitstream consisting of a core (or base) layer (an adaptive codebook together with a fixed codebook 0) plus N enhancement layers (fixed codebooks 1 through N). For a general discussion on fixed (or algebraic) codebooks, see, e.g., Adoui, et al., "Fast CELP Coding Based on Algebraic Codes," in Proc. IEEE Int. Conf on Acoustics, Speech, Signal Processing, (Dallas), pp. 1957-1960, April 1987.

A layered encoder uses only the core layer at the lowest bit rate to give acceptable quality and provides progressively enhanced quality by adding progressively more enhancement layers to the core layer. A layer's fixed codebook entry is found by minimizing the error between the input speech and the so-far cumulative synthesized speech. Layering is useful for some Voice-over-Internet-Protocol (VoIP) applications including different Quality-of-Service (QoS) offerings, network congestion control and multicasting. For different QoS service offerings, a layered encoder can provide several options of bit rate by increasing or decreasing the number of enhancement layers. For network congestion control, a network node can strip off some enhancement layers and lower the bit rate to ease network congestion. For multicasting, a receiver can retrieve appropriate number of bits from a single layer-structured bitstream according to its connection to the network.

CELP speech encoders apparently perform well in the 6-16 kb/s bit rates often found with VoIP transmissions. However, known CELP speech encoders that employ a layered (embedded) coding design do not perform as well at higher bit rates. A non-layered CELP speech encoder can optimize its parameters for best performance at a specific bit rate. Most parameters (e.g., pitch resolution, allowed fixed-codebook pulse positions, codebook gains, perceptual weighting, level of post-processing) are typically optimized to the operating bit rate. In a layered encoder, optimization for a specific bit rate is limited as the encoder performance is evaluated at many bit rates. Furthermore, CELP-like encoders incur a bit-rate penalty with the embedded constraint; a non-layered encoder can jointly quantize some of its parameters (e.g., fixed-codebook pulse positions), while a layered encoder cannot. In a layered encoder extra bits are also needed to encode the gains that correspond to the different bit rates, which require additional bits. Typically, the more embedded enhancement layers that are considered, the larger the bit-rate penalties. So for a given bit rate, non-layered encoders outperform layered encoders.

SUMMARY OF THE INVENTION

To address the above-discussed deficiencies of the prior art, one aspect of the invention provides a layered CELP encoder. In one embodiment, the encoder includes: (1) a core layer subencoder and (2) at least one enhancement layer subencoder, at least one of the core layer subencoder and the enhancement layer subencoder having first and second adaptive codebooks and configured to retrieve a pitch lag estimate from the second adaptive codebook and perform a closed-loop search of the first adaptive codebook based on the pitch lag estimate.

In another aspect, the invention provides an AMR-WB encoder. In one embodiment, the encoder includes: (1) a core layer subencoder and (2) plural enhancement layer subencoders, at least one of the core layer subencoder and the plural enhancement layer subencoders having first and second adaptive codebooks and configured to retrieve a pitch lag estimate from the second adaptive codebook and perform a closed-loop search of the first adaptive codebook based on the pitch lag estimate.

In yet another aspect, the invention provides a method of layered CELP encoding. In one embodiment, the method is for use in a CELP encoder having a core layer subencoder and at least one enhancement layer subencoder, at least one of the core layer subencoder and the enhancement layer subencoder having first and second adaptive codebooks. In one embodiment, the method includes: (1) retrieving a pitch lag estimate from the second adaptive codebook and (2) performing a closed-loop search of the first adaptive codebook based on the pitch lag estimate.

In still other aspects, the invention provides decoders for receiving and decoding bitstreams of coefficients produced by the encoders or methods.

BRIEF DESCRIPTION OF THE DRAWINGS

For a more complete understanding of the invention, reference is now made to the following descriptions taken in conjunction with the accompanying drawings, in which.

DETAILED DESCRIPTION

1. Overview

Various embodiments of layered CELP speech encoders, decoders and methods of layered CELP encoding and decoding will be described herein. Some embodiments use separate gains for adaptive and fixed contributions to excitation in at least some enhancement layers. Other embodiments use a separate codebook of adaptive and fixed contributions for closed-loop pitch lag searching. Still other embodiments use both separate gains for contributions and separate codebooks for pitch-lag search.

Various embodiments of the encoders perform coding using digital signal processors (DSPs), general purpose programmable processors, application specific circuitry, and/or systems on a chip such as both a DSP and RISC processor on the same integrated circuit. Codebooks may be stored in memory at both the encoder and decoder, and a stored program in an onboard or external ROM, flash EEPROM, or ferroelectric RAM for a DSP or programmable processor may perform the signal processing. Analog-to-digital converters and digital-to-analog converters provide coupling to analog domains, and modulators and demodulators (plus antennas for air interfaces) provide coupling for transmission waveforms. The encoded speech can be packetized and transmitted over networks such as the Internet.

Figure 1:
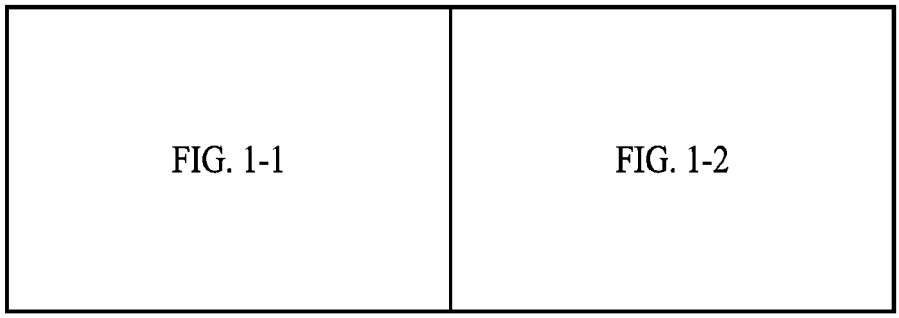
FIG. 1 is a block diagram of one embodiment of an AMR-WB speech encoder.

Before describing various embodiments of encoders, decoders and methods in detail, an example of the overall architecture of a layered CELP speech encoder constructed according to the principles the invention and layered CELP encoding and decoding will be described. FIG. 1 is a block diagram of the overall architecture of one embodiment of an AMR-WB speech encoder. FIG. 1 consists of FIGS. 1-1 and 1-2 placed alongside one another as shown. With reference to FIG. 1-1, the encoder receives input speech 100, which may be in analog or digital form. If in analog form, the input speech is then digitally sampled (not shown) to convert it into digital form. The input speech 100 is then downsampled as necessary and highpass filtered 102 and pre-emphasis filtered 104. The filtered speech is windowed and autocorrelated 106 and transformed first into A(z) form and then into ISPs 108.

The ISPs are interpolated 110 to yield (e.g., four) subframes. The subframes are weighted 112 and open-loop searched to determine their pitch 114. The ISPs are also further transformed into ISFs and quantized 116. The quantized ISFs are stored in an ISF index 118 and interpolated 120 to yield (e.g., four) subframes.

Figure 1:
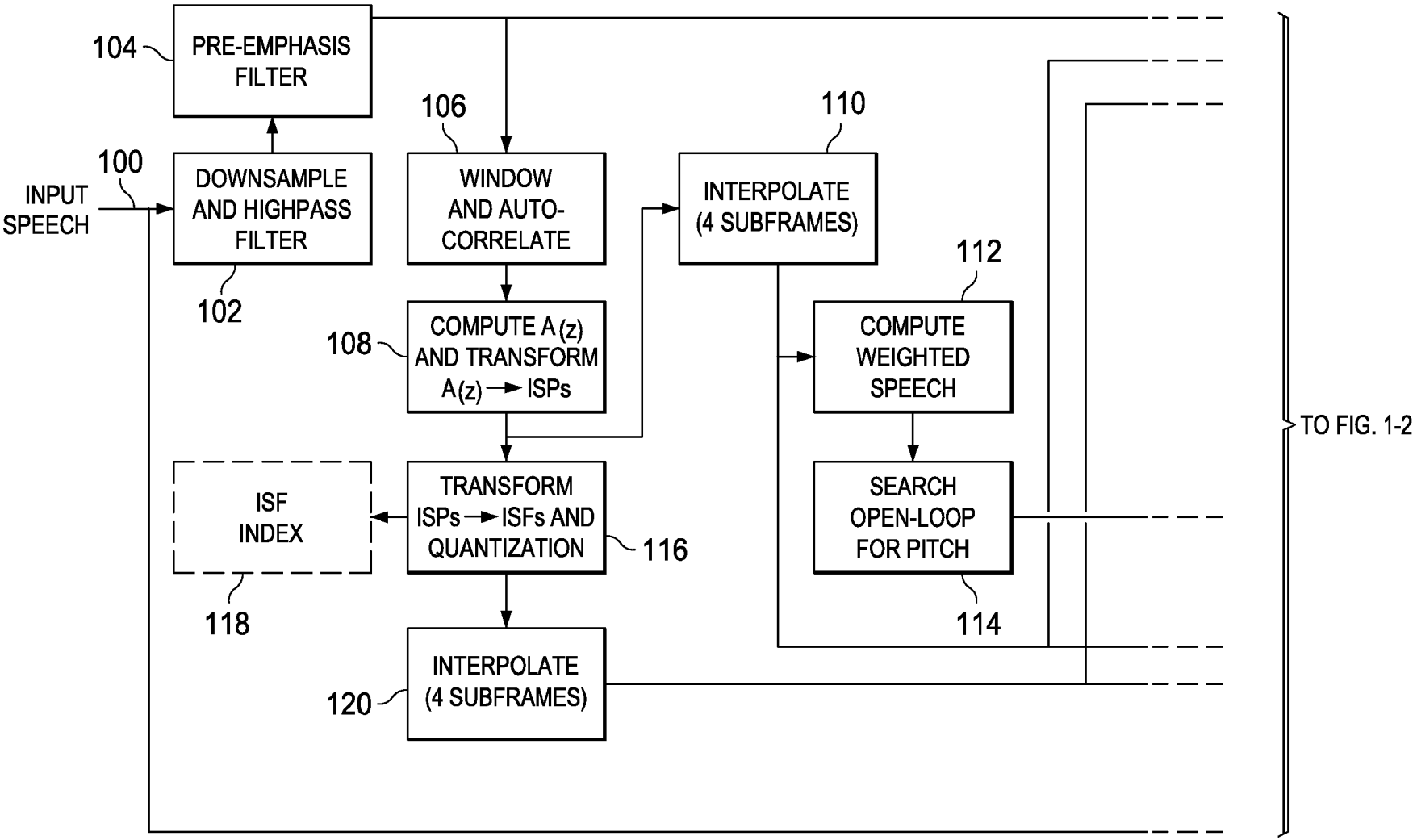
Figures 1, 2:
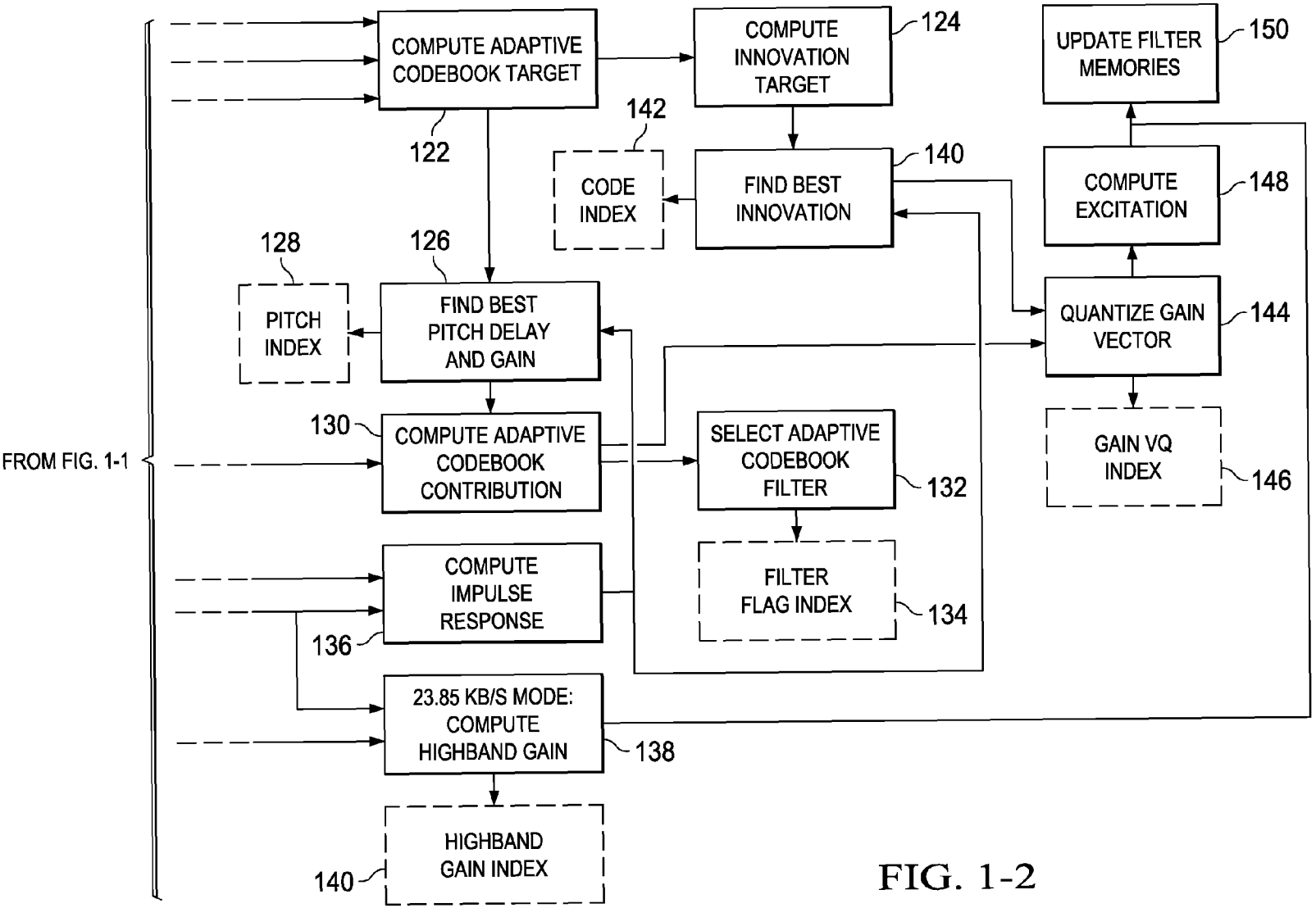

With reference to FIG. 1-2, the speech that was emphasis-filtered 104, the interpolated ISPs and the interpolated, quantized ISFs are employed to compute an adaptive codebook target 122, which is then employed to compute an innovation target 124. The adaptive codebook target is also used, among other things, to find a best pitch delay and gain 126, which is stored in a pitch index 128.

The pitch that was determined by open-loop search 114 is employed to compute an adaptive codebook contribution 130, which is then used to select and adaptive codebook filter 132, which is then in turn stored in a filter flag index 134.

The interpolated ISPs and the interpolated, quantized ISFs are employed to compute and impulse response 136. The interpolated, quantized ISFs, along with the unfiltered digitized input speech 100, are also used to compute highband gain for the 23.85 kb/s mode 138.

The computed innovation target and the computed impulse response are used to find a best innovation 140, which is then stored in a code index 142. The best innovation and the adaptive codebook contribution are used to form a gain vector that is quantized 144 in a Vector Quantizer (VQ) and stored in a gain VQ index 146. The gain VQ is also used to compute an excitation 148, which is finally used to update filter memories 150.

Figure 2A:
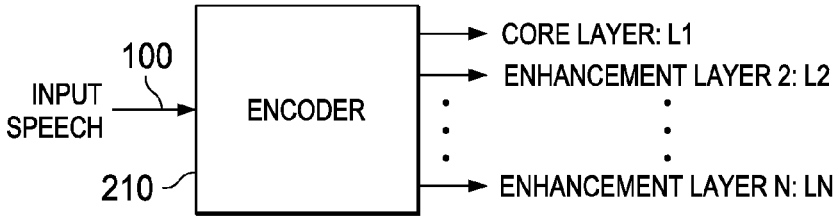
FIGS. 2A and 2B are block diagrams of a layered CELP speech encoder and various layered CELP decoders.
Figure 2B:
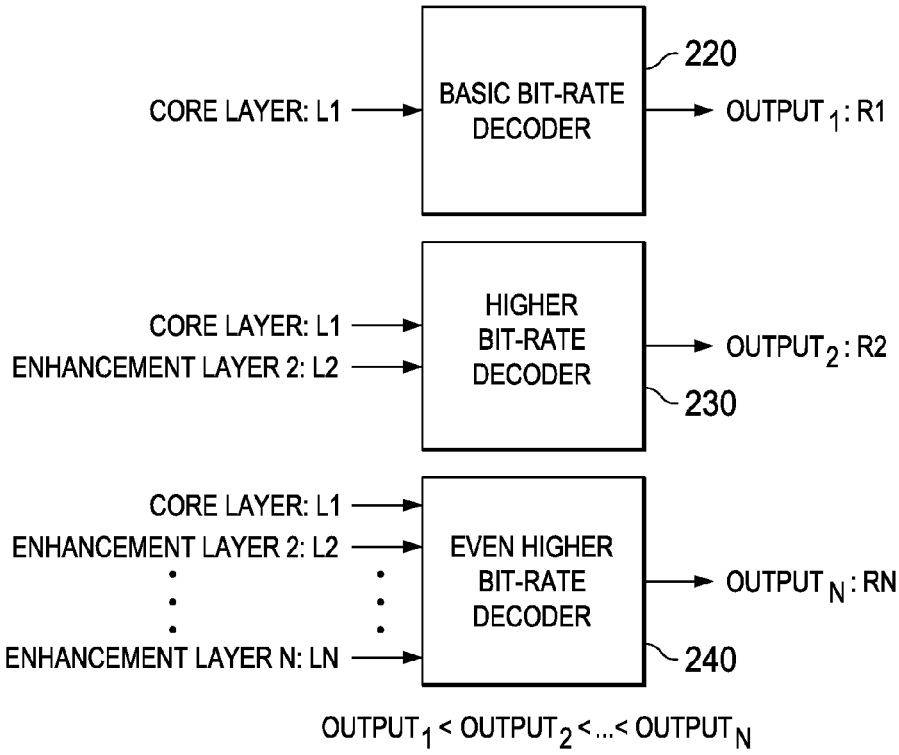

FIGS. 2A and 2B are block diagrams of a layered CELP speech encoder and various layered CELP decoders. They are presented for the purpose of showing layered CELP encoding and decoding at a conceptual level.

FIG. 2A shows a layered CELP speech encoder 210. The encoder receives input speech 100 and produces a core layer, L1, and one or more enhancement layers, enhancement layer 2 (L2), . . . , enhancement layer N (LN). FIG. 2B shows three layered CELP decoders. A basic bit-rate decoder 220 receives or selects only the core layer, L1, from the CELP speech encoder 210 and uses this to produce an $output_1$, R1. A higher bit-rate decoder 230 receives or selects not only the core layer, L1, but also the enhancement layer, L2, from the CELP speech encoder 210 and uses these to produce an $output_2$, R2. An even higher bit-rate decoder 240 receives the core layer, L1, the enhancement layer, L2, and all other enhancement layers up to enhancement layer N, LN, from the CELP speech encoder 210 and uses these to produce an $output_N$, RN. As FIG. 2B indicates, the quality of $output_1$ is less than the quality of $output_2$, which, in turn, is less than the quality of $output_N$. Of course, many layers of enhancement may exist between L2 and LN, and correspondingly many levels of quality may exist between $output_2$ and $output_N$.

Figure 3:
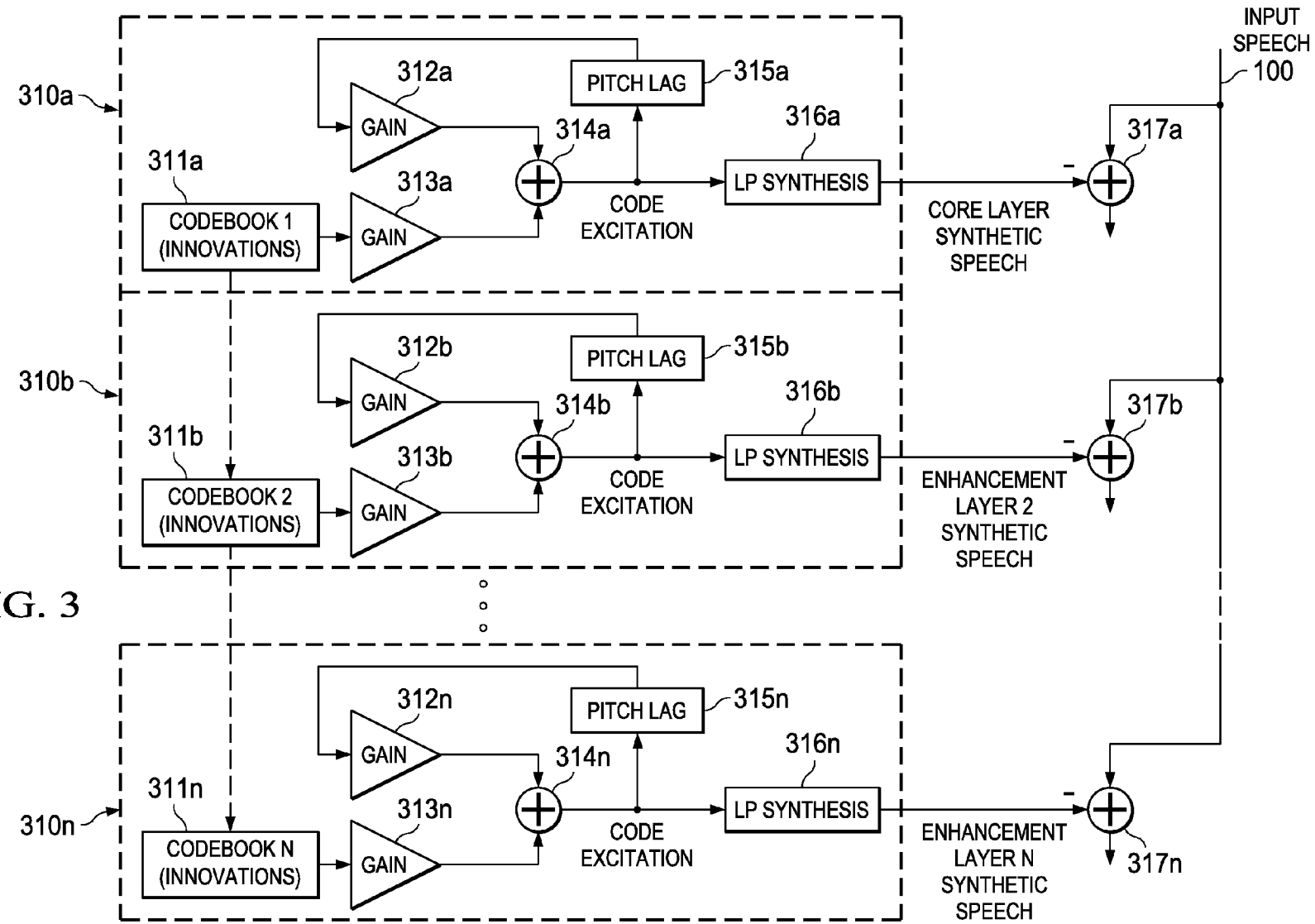
FIG. 3 is a block diagram of one embodiment of a CELP speech encoder having plural codebook contributions in enhancement layers thereof.

FIG. 3 is a block diagram of one embodiment of a layered CELP speech encoder, e.g., the CELP speech encoder of FIG. 2A. The CELP speech encoder has plural codebook contributions in enhancement layers thereof. The illustrated encoder has a plurality of subencoders 310*a*, 310*b*, 310*n*. The subencoder 310*a* corresponds to the core layer, L1, and therefore will be referred to as a core layer subencoder. The subencoder 310*b* corresponds to enhancement layer 2, L2, and therefore will be referred to as an enhancement layer 2 subencoder. The subencoder 310*n* corresponds to enhancement layer N, LN, and therefore will be referred to as an enhancement layer N subencoder.

The core layer subencoder 310*a* contains a fixed codebook 311*a* containing innovations, fixed-gain and adaptive-gain multipliers 312*a*, 313*a*, a summing junction 314*a* and a pitch filter feedback loop 315*b* to the adaptive-gain multiplier 313*a*. The output of the summing junction 314*a* provides code excitation to an LP synthesis filter 316*a*, which in turn provides its output to a summing junction 317*a* where it is subtracted from the input speech 100. The enhancement layer 2 subencoder 310*b* contains a fixed codebook 311*b* containing innovations, fixed-gain and adaptive-gain multipliers 312*b*, 313*b*, a summing junction 314*b*, a pitch filter feedback loop 315*b* to the adaptive-gain multiplier 313*b* and an LP synthesis filter 316*b*. The LP synthesis filter 316*b* provides its output to a summing junction 317*b* where it too is subtracted from the input speech 100. The enhancement layer N subencoder 310*n* contains a fixed codebook 311*n* containing innovations, fixed-gain and adaptive-gain multipliers 312*n*, 313*n*, a summing junction 314*n*, a pitch filter feedback loop 315*n* to the adaptive-gain multiplier 313*n* and an LP synthesis filter 316*n*. The LP synthesis filter 316*n* provides its output to a summing junction 317*n* where it too is subtracted from the input speech 100.

In a CELP speech encoder, the LP excitation is generated as a sum of a pitch filter output (sometimes implemented as an adaptive codebook) and an innovation (implemented as a fixed codebook). Entries in the adaptive and fixed codebooks are selected based on the perceptually weighted error between input signal and synthesized speech through analysis-by-synthesis. The adaptive-codebook (pitch) contribution models the periodic component present in speech, while the fixed-codebook contribution models the non-periodic component. The adaptive codebook is specified by a past LP excitation, pitch lag and pitch gain. The fixed codebook can be efficiently represented with an algebraic codebook which contains a fixed number of non-zero pulse patterns that are limited to specific locations, and the corresponding gain.

2. Gain Quantization in General

As described above, a layered encoder generates a bit stream that consists of a core layer and a set of enhancement layers. The decoder decodes a basic version of the encoded signal from the bits of the core layer or enhanced versions of the encoded signal if one or more enhancement layers are also received or selected by the decoder.

In a typical implementation of a layered CELP speech encoder, the adaptive and fixed codebook contributions of the core layer are chosen through CELP analyses-by-syntheses, and the error between the input signal and the synthesized speech is passed on as an input to the analysis-by-synthesis processing of the enhancement layers. For a general discussion of analysis-by-synthesis, see, Kroon, et al., "A Class of Analysis-by-Synthesis Predictive Coders for High Quality Speech Coding at Rates Between 4.8 and 16 kbits/s," in IEEE Journal on Selected Areas in Communications, pp. 353-363, February 1988. The encoding error from the subsequent enhancement layers is passed on as input to the following layers. In conventional encoders, only the core layer contains the adaptive-codebook contribution.

The enhancement layers of some existing encoders have a modified fixed-codebook structure that accounts for characteristics of the signal generated in lower layers (see the co-pending U.S. patent application Ser. No. 11/279,932 cross-referenced above), but no existing encoders use an adaptive codebook in any enhancement layer. In contrast, the illustrated embodiments use both adaptive codebook and fixed-codebook contributions in at least one of the enhancement layers. Some embodiments use both adaptive codebook and fixed-codebook contributions in all layers. In the latter embodiments, each layer of the encoder optimizes its parameters with respect to the original input signal and not with respect to the quantization error of the previous layer. That is, the adaptive and fixed codebook gains in a layered CELP speech encoder are encoded with the pitch contribution in all layers. Separate gains are applied for each contribution in every layer, i.e., four gains are used in the second layer, L2: two gains for adaptive and fixed contributions from L1, and two gains for adaptive and fixed contributions from L2. The gains corresponding to the L1 adaptive and fixed contributions are first quantized when considered in the context of the L1 core layer, and then re-quantized jointly with the additional two gains corresponding to the L2 adaptive and fixed contributions. The four L2 gains are encoded with a VQ as four correction factors to the two L1 quantized gains. To limit the possible discrepancy between the optimal gains and the gain quantizer, the optimal gains estimated prior to the L2 fixed-codebook search are restricted to match the range of the gain-correction codebooks.

3. Separate Gains for Adaptive and Fixed Contributions in at Least One Enhancement Layer For the purpose of explanation, the following notation will be used:

X—ideal excitation (quantization target);
x—encoded and decoded excitation;
a—adaptive codebook entry;
aG—optimal gain for the adaptive codebook entry, a;
ag—encoded gain for the adaptive codebook entry, a;
c—fixed codebook entry (innovation or excitation);
cG—optimal gain for the fixed codebook entry, c; and
cg—encoded gain for the fixed codebook entry, c.

To associate the parameters with embedded layers, numerals are added to these symbols. For example, x1 and x2 represent encoded excitations in layers L1 and L2, respectively.

In the core layer, L1, one embodiment of a layered CELP decoder carries out the following:

$$x1-ag1*a1+cg1*c1$$

At the encoder, the following steps may be carried out to encode x1:

perform a search for an adaptive excitation a1 (a pitch-lag estimation):

$$\min(X-aG1*a1)^2$$

perform a search for a fixed excitation c1:

$$\min(X-aG1*a1-cG1*c1)^2$$

with a1 and c1 selected, perform a closed-loop search for ag1 and cg1 gains:

$$\min(X-ag1*a1-cg1*c1)^2$$

Note that minimizations of the errors are typically performed in a perceptually-weighted domain.

For the second layer, L2, one embodiment of the layered CELP decoder performs the following:

$$x2=ag21*a1+ag22*a2+cg21*c1+cg22*c2$$

Note that ag21 and cg21, the quantized gains applied to a1 and c1 when decoding x2, are typically different from ag1 and cg1, the gains applied to a1 and c1 when decoding x1. Modifying a1 and c1 from L1 to L2 falls within the scope of the invention, but would require a substantial number of additional bits and may be impractical to carry out in many applications. Modifying ag1 to ag21 and cg1 to cg21 instead is feasible with only a small number of additional bits.

At the encoder, the following steps may be carried out to encode x2:

perform a search for an adaptive excitation a2:

to save bits, the same pitch-lag that was used in the search for a1 may again be used perform a search for a fixed excitation c2:

$$\min(X-aG21*a1-aG22*a2-cG21*c1-cG22*c2)^2$$

with a1, a2, c1 and c2 selected, perform a closed-loop search for ag21, ag22, cg21 and cg22 gains.

Note that other variations of this general configuration are possible, for example, a c2 search with quantized gains ag21, ag22, and cg21, followed by re-quantization of all gains.

Conventional layered CELP speech encoders employ a simplified version of the configuration above. For example, a conventional layered CELP decoder carries out:

$$x2=ag1*a1+cg1*c1+cg22*c2$$

with the encoder carrying out:

a search for a fixed excitation c2:

$$\min(X-ag1*a1-cg1*c1-cG22*c2)^2$$

a quantization of cG22

Note the missing a2 component and the reusing of the ag1 and cg1 gains from L1. In the co-pending U.S. patent application Ser. No. 11/279,932 cross-referenced above, the layered CELP decoder carried out:

$$x2=ag22*(a1+a2)+cg22*(s2*c1+c2)$$

with the encoder carries out:

a search for a fixed excitation c2:

$$\min(X-aG22*(a1+a2)-cG22*(s2*c1+c2)$$

a closed-loop search for ag22 and cg22

This embodiment may be advantageous when many enhancement layers are considered, but may be suboptimal for a small number of enhancement layers. Although a1 and a2 share a common gain, ag22, it is different from the gain ag1 used in L1. In one embodiment, the gain scaling factor s2 applied to c1 was fixed. In an alternative embodiment, the gain scaling factor s2 could also be encoded. This scaling factor was modified for each consecutive layer.

The principles described above with respect to L2 can be advantageously extended to consecutive layers, e.g., L3, etc. In L3, for example, one embodiment employs six gains: two gains corresponding to the L1 adaptive and fixed contributions, two gains corresponding to the L2 adaptive and fixed contributions, and two gains corresponding to the L3 contributions.

For improved encoding efficiency, the four L2 gains may be quantized with VQ as four correction factors to the two L1 quantized gains, typically in the log domain.

When estimating the fixed-codebook contribution for L2, optimal gains for the L1 adaptive and fixed codebooks and L2 adaptive codebook are first jointly evaluated. To limit the possible discrepancy between the optimal gains and gain quantizer, the calculated optimal gains are then restricted to match the range of the gain-correction codebooks.

Figure 4:
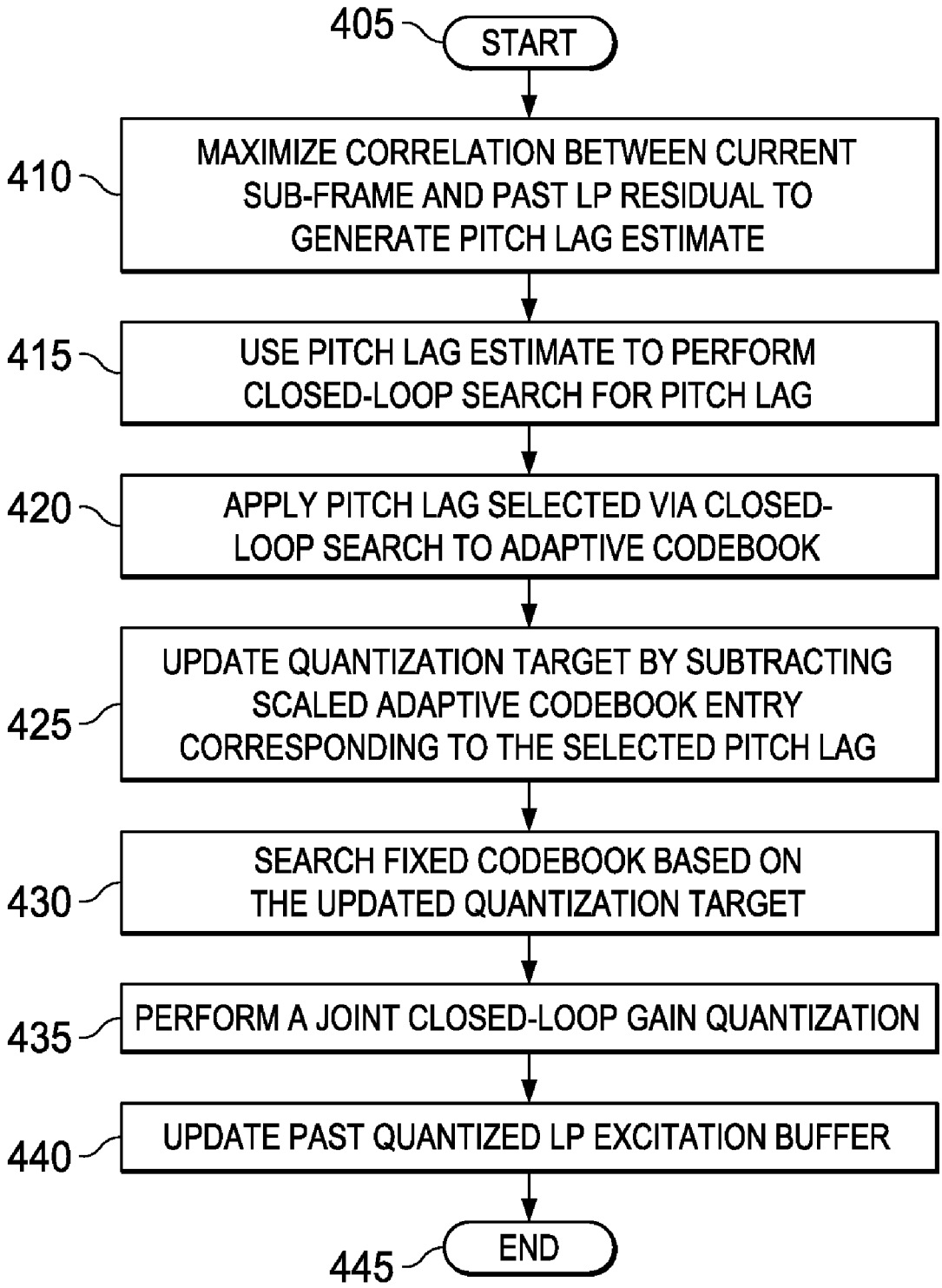
FIG. 4 is a flow diagram of one embodiment of a method of layered CELP speech encoding that employs plural codebook contributions in enhancement layers.

FIG. 4 is a flow diagram of one embodiment of a method of layered CELP speech encoding that employs plural codebook contributions in enhancement layers. The method begins in a step 405.

In a step 410, the correlation between the current sub-frame and the past LP residual is maximized to generate a pitch lag estimate. In a step 420, this pitch lag estimate is used to perform a closed-loop search for the pitch lag.

Once the pitch lag is determined via the closed-loop search, it is then applied to the adaptive codebook in a step 420 so that the encoder and the decoder maintain signal synchrony needed for the analysis-by-synthesis encoding. Next, in a step 425, the quantization target is updated by subtracting the scaled adaptive codebook entry corresponding to the pitch lag determined via the closed-loop search that was carried out in the step 420. A fixed-codebook search follows in a step 430.

After the fixed-codebook contribution is found in the step 430, a joint closed-loop gain quantization is performed in a step 435, and the past quantized LP excitation buffer is updated in a step 440 by scaling the codebook contributions with their corresponding gains. This buffer is used in the next sub-frame to populate the adaptive codebook. The method ends in a step 445.

4. Pitch Estimation Based on Optimum-Gain LP Excitation

As stated above, some embodiments disclosed herein perform closed-loop pitch estimation with an LP excitation corresponding to optimal gains. These embodiments therefore use a different signal for estimating pitch-lag than for generating pitch contribution. In a typical CELP implementation, the pitch lag is estimated in a two-step process in each processing sub-frame (e.g., a 5 ms data block). First, an "open loop" analysis is performed, followed by a "closed loop" search; see FIG. 1. In the open-loop analysis, a pitch lag is estimated by maximizing the correlation between the current sub-frame and past LP residual. The closed-loop search, which is computationally more expensive, then refines this initial estimated pitch lag to result in a more reliable pitch lag and a corresponding pitch gain. In this step, analysis-by-synthesis is performed for a number of adaptive-codebook entries (corresponding to tested pitch lags) close to the open-loop estimate; the adaptive codebook is populated with data obtained from past quantized LP excitation.

Once the closed-loop pitch lag and the corresponding pitch gain are determined, the pitch contribution is subtracted from the target speech to generate the target vector for the fixed-codebook search. After the fixed codebook contribution is selected, the gains of the adaptive and fixed codebooks are jointly determined by a closed-loop procedure in which a set of gain codebook entries are searched to minimize the error between (perceptually weighted) input and synthesized speech. The quantized LP excitation (sum of scaled adaptive and fixed-codebook contributions) is then used in the next sub-frame for the new closed-loop pitch estimation.

Figure 5:
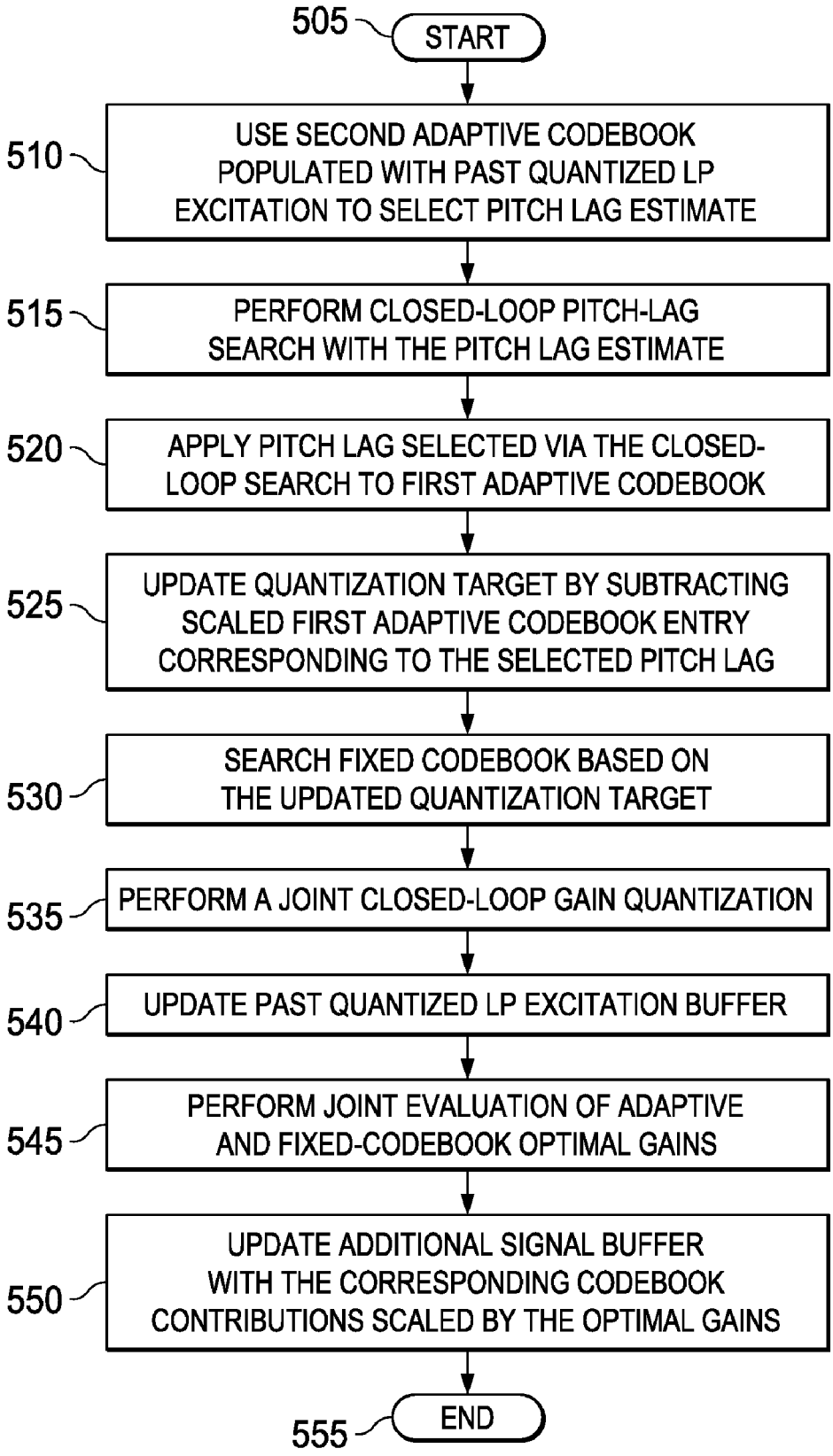
FIG. 5 is a flow diagram of one embodiment of a method of layered CELP speech encoding in which closed-loop pitch estimation is performed with the LP excitation corresponding to optimal gains.

FIG. 5 is a flow diagram of one embodiment of a method of layered CELP speech encoding in which closed-loop pitch estimation is performed with the LP excitation corresponding to optimal gains. As described above, in applications employing low bit-rate coding (when the gains are quantized with few bits) or fixed-point encoding, conventional gain quantization may introduce undesired signal variations into the quantized LP excitation which may then result in pitch misrepresentation. The method of FIG. 5 has the advantage of decoupling the pitch estimation from artifacts potentially introduced by gain quantization and therefore effectively addresses this problem. The method begins in a step 505.

In a step 510, a second adaptive codebook populated with the LP excitation corresponding to previous adaptive and fixed codebook contributions scaled by jointly evaluated optimal gains is used to select the pitch lag estimate. In a step 515, a pitch-lag estimation closed-loop pitch search is performed.

Once the pitch lag is selected, it is then applied to the first adaptive codebook (which includes past quantized LP excitation) in a step 520 so that the encoder and the decoder maintain signal synchrony needed for the analysis-by-synthesis encoding. Next, in a step 525, the quantization target is updated by subtracting from it the (scaled) entry from the first adaptive codebook, which corresponds to the selected pitch lag. A fixed-codebook search follows in a step 530.

After the fixed-codebook contribution is found in the step 530, a joint closed-loop gain quantization is performed in a step 535, and the past quantized LP excitation buffer is updated in a step 540 by scaling the codebook contributions with their corresponding gains. This buffer is used in the next sub-frame to populate the first adaptive codebook.

A (joint) evaluation of the adaptive and fixed-codebook optimal gains is performed in a step 545, and an additional signal buffer (to be used for the second adaptive codebook) is updated in a step 550 with the corresponding codebook contributions scaled by the optimal gains. The method ends in a step 555.

Of course, closed-loop pitch estimation performed with the LP excitation corresponding to optimal gains need not be carried out in conjunction with plural codebook contributions in enhancement layers. Thus, some embodiments of CELP encoders may use optimal gains to carry out pitch estimation, but then use the pitch lag that ultimately results from that estimation only in the core layer or certain enhancement layers, even if those same encoders use plural codebook contributions in a greater number of, or all, enhancement layers.

5. Modifications

The embodiments described above may be modified in various other ways while retaining the features of layered CELP coding with the gain quantizations and the general pitch estimation. For example, instead of AMR-WB, a G.729 or other type of CELP could be used. Those skilled in the art to which the invention relates will appreciate that other modifications and other and further additions, deletions and substitutions may be made to the described embodiments without departing from the scope of the invention.

What is claimed is:

1. A layered CELP encoder, comprising:

a core layer subencoder; and at least one enhancement layer subencoder for performing pitch lag estimation with optimal gains in the CELP encoder, wherein at least one of said core layer subencoder and said enhancement layer subencoder having first and second adaptive codebooks and configured to retrieve a pitch lag estimate from said second adaptive codebook and perform a closed-loop search of said first adaptive codebook based on said pitch lag estimate.

2. The encoder as recited in claim 1 wherein said at least one enhancement layer subencoder has an adaptive-gain multiplier configured to apply a gain for an adaptive contribution to excitation and a fixed-gain multiplier configured to apply a gain for a fixed contribution to said excitation that is separate from said gain for said adaptive contribution.

3. The encoder as recited in claim 2 wherein each of said at least one enhancement layer subencoder is configured to apply separate gains for adaptive and fixed contributions to excitation.

4. The encoder as recited in claim 2 wherein said at least one enhancement layer subencoder is configured to apply said gain for said adaptive contribution to an entry retrieved from said first adaptive codebook.

5. The encoder as recited in claim 1 wherein said at least one enhancement layer subencoder is configured to optimize parameters with respect to an original input signal.

6. The encoder as recited in claim 1 wherein said at least one enhancement layer subencoder is configured to employ an analysis-by-synthesis process jointly to determine said gain for said adaptive contribution to excitation and said gain for said fixed contribution.

7. The encoder as recited in claim 1 wherein said encoder is an Adaptive Multirate Wideband encoder.

8. A method of layered CELP encoder, wherein the CELP encoder comprises at least one core layer subencoder and at least one enhancement layer subencoder having first and second adaptive codebooks, the method comprising:

retrieving, via said encoder, a pitch lag estimate from said second adaptive codebook; and performing a closed-loop search of said first adaptive codebook based on said pitch lag estimate;

wherein the pitch lag estimation relates to optimal gains in the CELP encoder.

9. The method as recited in claim 8 further comprising:

applying a gain for an adaptive contribution to excitation in at least one enhancement layer; and further applying a gain for a fixed contribution to said excitation in said at least one enhancement layer, said gain for said fixed contribution being separate from said gain for said adaptive contribution.

10. The method as recited in claim 9 wherein said applying and said further applying are carried out in each of said at least one enhancement layer.

11. The method as recited in claim 9 wherein said applying comprises applying said gain for said adaptive contribution to an entry retrieved from said first adaptive codebook.

12. The method as recited in claim 8 further comprising optimizing parameters with respect to an original input signal.

13. The method as recited in claim 8 further comprising employing an analysis-by-synthesis process jointly to determine said gain for said adaptive contribution to excitation and said gain for said fixed contribution.

14. The method as recited in claim 8 further comprising employing coefficients resulting from said applying and said further applying to decode at least a portion of said bitstream.

15. An Adaptive Multirate Wideband encoder, comprising:

a core layer subencoder; and plural enhancement layer subencoders for performing pitch lag estimation with optimal gains in the Adaptive Multirate Wideband encoder, wherein at least one of said core layer subencoder and said plural enhancement layer subencoders having first and second adaptive codebooks and configured to retrieve a pitch lag estimate from said second adaptive codebook and perform a closed-loop search of said first adaptive codebook based on said pitch lag estimate.

16. The encoder as recited in claim 15 wherein at least one of said plural enhancement layer subencoders have an adaptive-gain multiplier configured to apply a gain for an adaptive contribution to excitation and a fixed-gain multiplier configured to apply a gain for a fixed contribution to said excitation that is separate from said gain for said adaptive contribution.

17. The encoder as recited in claim 16 wherein each of said plural one enhancement layer subencoders is configured to apply separate gains for adaptive and fixed contributions to excitation.

18. The encoder as recited in claim 16 wherein said at least one of said plural enhancement layer subencoders is configured to apply said gain for said adaptive contribution to an entry retrieved from said first adaptive codebook.

19. The encoder as recited in claim 16 wherein said each of said plural enhancement layer subencoders is configured to employ an analysis-by-synthesis process jointly to determine said gain for said adaptive contribution to excitation and said gain for said fixed contribution.

20. A decoder configured to receive a bitstream of coefficients from the Adaptive Multirate Wideband encoder of claim 15 and employ said coefficients to decode at least a portion of said bitstream.

* * * * *